US005094015A

United States Patent [19]

Griffith

[11] Patent Number: 5,094,015

[45] Date of Patent: Mar. 10, 1992

[54] CLOTHES DRYER REPAIR PRODUCT

[76] Inventor: Daniel B. Griffith, 932 Main St., Minturn, Colo. 81645

[21] Appl. No.: 650,224

[22] Filed: Feb. 4, 1991

[51] Int. Cl.[5] ..... F26B 19/00

[52] U.S. Cl. ..... 34/235; 29/402.01; 29/402.08; 29/402.09; 29/402.11

[58] Field of Search ..... 29/402.01, 402.03, 402.04, 29/402.06, 402.08, 402.09, 402.11; 34/235; 239/590.3, DIG. 23; 210/435, 455

[56] References Cited

U.S. PATENT DOCUMENTS

| | | | |
|---|---|---|---|
| 2,241,257 | 5/1941 | Gronberg | 140/3 R |
| 2,283,803 | 5/1942 | Gittens | 245/2 |
| 2,397,646 | 4/1946 | Brown et al. | 219/58 |
| 3,049,836 | 8/1962 | Weissman | 29/402.09 |
| 3,270,965 | 9/1966 | Aghnides | 239/590.3 |
| 4,222,162 | 9/1980 | Levy et al. | 29/402.09 |
| 4,460,420 | 7/1984 | Estrada | 29/402.11 |
| 4,493,815 | 1/1985 | Fernwood et al. | 210/455 |
| 4,517,038 | 5/1985 | Miller | 29/402.11 |
| 4,691,423 | 9/1987 | Willyard, Jr. et al. | 29/402.08 |
| 4,720,925 | 1/1988 | Czech et al. | 34/82 |
| 4,760,980 | 8/1988 | Sharpe | 245/2 |

FOREIGN PATENT DOCUMENTS

| | | | |
|---|---|---|---|
| 165312 | 7/1949 | Switzerland | 29/402.09 |

OTHER PUBLICATIONS

Frigidaire Laundry Center Parts (Exhibit AR).

*Primary Examiner*—P. W. Echols
*Assistant Examiner*—David P. Bryant
*Attorney, Agent, or Firm*—Joseph J. Kelly

[57] ABSTRACT

A product for repairing a clothes dryer lint duct which originally has a base member having a central perforated area at least partially surrounded by an imperforate area. When the central perforated area of the original base member becomes brittle, it is broken away leaving at least a portion of the imperforate area. A product having a new base member having a central perforate area at least partially surrounded by an imperforate area is then attached to the remaining imperforate area of the original base member.

9 Claims, 1 Drawing Sheet

CLOTHES DRYER REPAIR PRODUCT

FIELD OF THE INVENTION

The invention relates generally to clothes dryers and more particularly to the repair of the duct system for removing the hot air and lint from the drum of the clothes dryer.

BACKGROUND OF THE INVENTION

All clothes dryers have a duct system for removing the hot air and lint from the drum of a clothes dryer. In one such system, the duct system has a dryer lint duct that has a perforated section that is exposed to the drum of the clothes dryer and through which the hot air and lint to pass through and an opening through which a lint screen is inserted to collect the lint passing through the perforated section. One such dryer lint duct is illustrated in Exhibit AR in the Information Disclosure Statement of this application and is incorporated herein by reference thereto. After an extended period of time, the perforated section becomes brittle and starts to break away and has sharp edges. When this happens, there is a decided tendency for the clothes to snag on the broken portions and the continued rotation of the drum results in torn clothing. Therefore, it is necessary to repair the clothes dryer. Conventionally, this has been accomplished by removing the dryer lint duct and installing a new dryer lint duct. This new dryer lint duct is expensive and added thereto is the expense of the service person. Therefore, there existed a need for a more economical system for replacing a broken dryer lint duct.

BRIEF DESCRIPTION OF THE INVENTION

This invention provides a product and method for repairing a broken dryer lint duct so that the clothes dryer can be returned to satisfactory operation in a more economical manner.

In a preferred embodiment of the invention, the dryer lint duct has a base member facing the drum of the clothes dryer. The base member has a central perforated area and an integral imperforate area surrounding the central perforated area. When a portion of the central perforated area breaks, a service person will open the clothes dryer door and reach through the drum and start to break away the remaining portion of the central perforated area. A tool, such as a pair of pliers, is used to carefully break away all of the central perforated area and part of the imperforate area and leaving the remaining portion of the imperforate area intact. The service person then installs a product having a central perforated area and an integral imperforate area surrounding the central perforated area. The imperforate area of the product is designed to mate with the remaining portion of the imperforate area of the dryer lint duct. The product is installed by using a heat resistant contact adhesive between at least portions of the imperforate area and the product. The product is smaller and has a significantly less complicated structure than the dryer lint duct so that it is much less expensive and can be installed in substantially less time that it takes to replace a broken dryer lint duct with a new dryer lint duct.

BRIEF DESCRIPTION OF THE DRAWING

An illustrative and presently preferred embodiment of the invention is shown in the accompanying drawing in which.

DETAILED DESCRIPTION OF THE INVENTION

Figure 1:
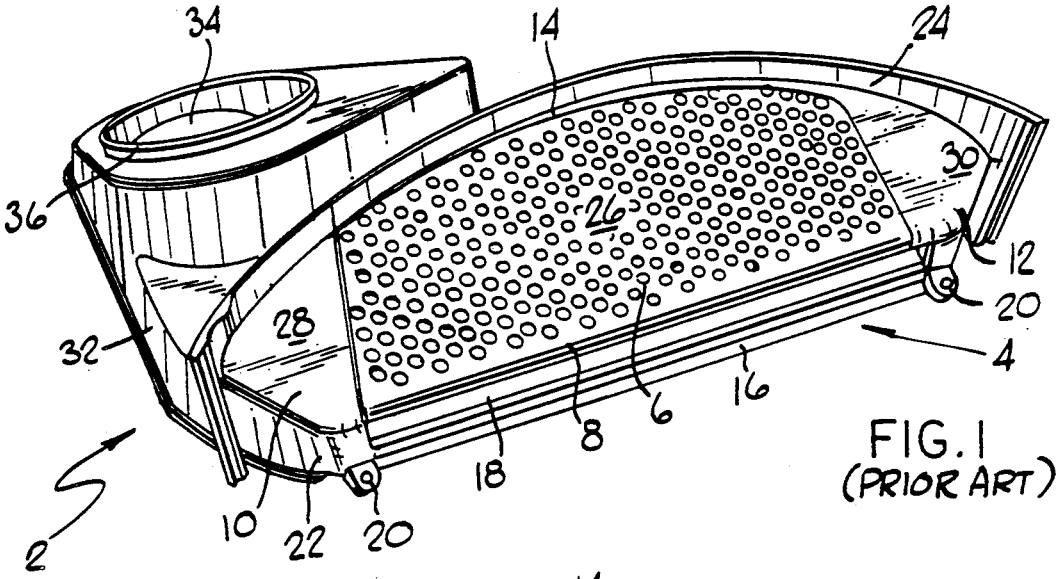
FIG. 1 (PRIOR ART)
FIG. 1 is a perspective view of a clothes dryer lint duct.

In FIG. 1, there is illustrated a dryer lint duct, presently used in a clothes dryer marketed by Frigidaire and is integrally molded using a relatively rigid, high temperature resistant plastic material. The dryer lint duct 2 has a base member 4 comprising a central perforated area 6 surrounded by an integral imperforate area comprising a front imperforate area 8, two side imperforate areas 10 and 12 and a rear imperforate area 14. An integral front wall portion 16 extends downwardly from the front imperforate area 8 and has an opening 18 formed therein for receiving a dryer lint screen (not shown). Mounting lugs 20 project outwardly from the front wall portion 16. Integral sidewall portions 22 extend downwardly from the side imperforate areas 10 and 12. An integral rear wall portion 24 has portions extending upwardly and downwardly from the rear imperforate area 14. The upper surface 26 of the central perforated area 6 lies in a plane slightly above the upper surfaces 28 and 30 of the side imperforate areas 10 and 12. A duct 32 is integral with a portion of the rear wall portion 24 and has an opening 34 having an extending lip portion 36 so that an exhaust duct (not shown) can be secured thereto.

When the central perforate area 6 becomes brittle and portions thereof break, as described above, a service person (not shown) will reach through an opened front door of the clothes dryer (not shown) through the drum (not shown) and begin to break away portions of the central perforated area 8 and remove them from the clothes dryer. The service person will continue to break away and remove portions of the central perforated area 8 until all of the central perforated area 6 and the front imperforate area 8 have been removed as illustrated in FIG. 2 leaving the side imperforate areas 10 and 12 and the rear imperforate area 14 intact.

Figure 3:
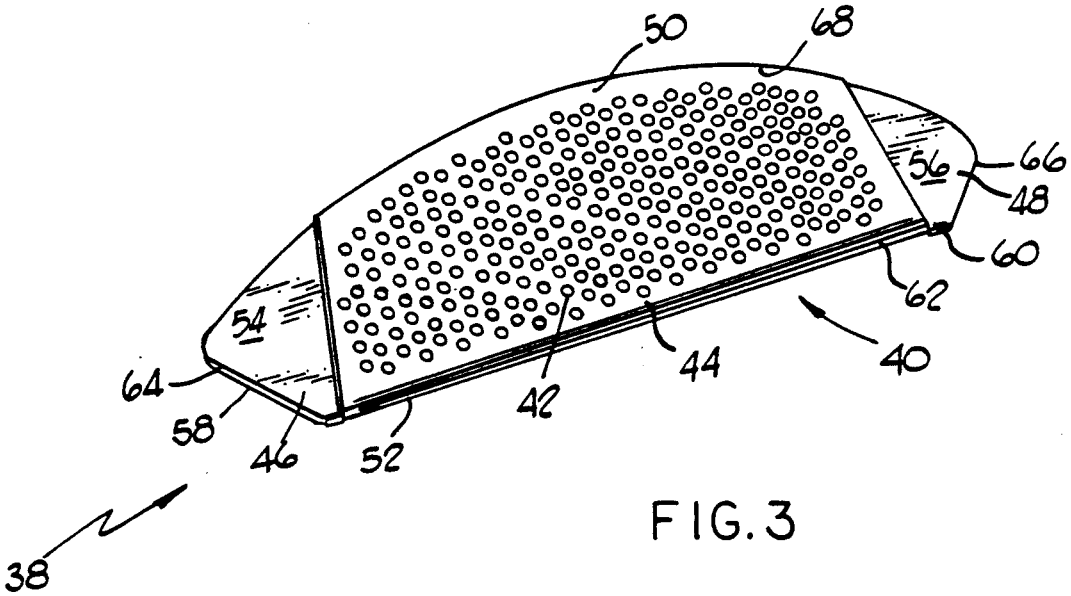
FIG. 3 is a perspective view of a product of this invention.

A product 38 of the invention is illustrated in FIG. 3 and is integrally molded using a relatively rigid, high temperature resistant plastic material. The product has a base member 40 comprising a central perforated area 42 surrounded by front imperforate area 44, two side imperforate areas 46 and 48 and a rear imperforate area 50. The bottom surface 52 of the central perforated area 42 lies in a plane substantially the same as the upper surfaces 54 and 56 of the side imperforate areas 46 and 48 so that the bottom surfaces 58 and 60 are in a plane lower than the bottom surface 52. The base member 40 has a linear front edge 62, two linear side edges 64 and 66 inclined to the linear front edge 62 and an arcuate rear edge 68. As illustrated in FIGS. 1 and 3, the base member 40 has a configuration corresponding to the base member 4. If the rear imperforate area 14 has a downwardly extending groove formed therein, a similarly shaped downwardly extending rim can be added to the rear imperforate area 50.

Figure 2:
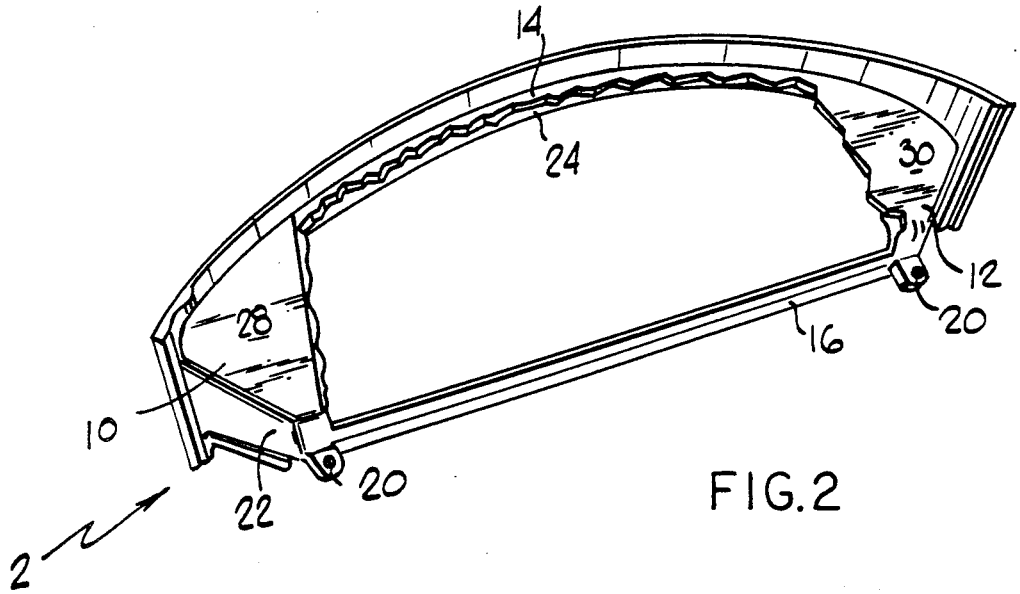
FIG. 2 is a perspective view of a clothes dryer lint duct having a portion removed therefrom.

After the central perforated area 8 has been broken away, as illustrated in FIG. 2, the service person takes a product 38 and applies a heat resistant contact adhesive (not shown), to portions of or all of the bottom surfaces 58 and 60 of the side imperforate areas 46 48 and/or the upper surfaces 28 and 30 of the side imperforate areas 10 and 12 and moves the product 40 through the drum and superposes the side imperforate areas 46 and 48 and rear imperforate area 50 over the side imperforate areas 10 and 12 and the rear imperforate area 14 and applies pressure to the product 38 to hold the product 38 in place. Since the bottom surfaces 58 and 60 are in a plane lower than the bottom surface 52, they can contact the upper surfaces 28 and 30. The clothes dryer is ready for satisfactory operation.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A product for use in repairing an original dryer lint duct of a clothes dryer wherein said original dryer lint duct has a base member comprising a central perforated area surrounded by an imperforate area and wherein at least a portion of the central perforated area has been removed, said product comprising:

a new base member having a central perforated area and an integral, imperforate area at least partially surrounding said central perforated area; and wherein at least portions of said imperforate area of said new base member are dimensioned to mate with and be attached to portions of said imperforate area of said original dryer lint duct.

2. A product as in claim 1 wherein:

said new base member is formed from a plastic material.

3. A product as in claim 1 wherein:

said imperforate area of said new base member is attached to said imperforate area of said original dryer lint duct using an adhesive.

4. A product as in claim 1 wherein said imperforate area of said new base member comprises:

at least one imperforate side portion projecting outwardly from said central perforated area; and at least one rear imperforate portion projecting outwardly from said central perforated area.

5. A product as in claim 1 wherein said imperforate area of said new base member comprises:

at least two imperforate opposite side portions projecting outwardly from said central perforated area; and at least one rear imperforate rear portion projecting outwardly from said central perforated area and extending between said at least two imperforate side portions.

6. A product as in claim 5 wherein:

each of said at least two imperforate side portions have bottom surfaces lying substantially in the same plane; and said central perforated area of said new base member has a bottom surface lying in a plane spaced above said plane of said bottom surfaces of said at least two imperforate side portions.

7. A product as in claim 6 wherein:

said new base member has a linear front edge, two linear side edges inclined to said front edge and an arcuate back edge.

8. A product as in claim 7 wherein:

said new base member is formed from a plastic material.

9. A product as in claim 7 wherein:

said imperforate area of said new base member is attached to said imperforate area of said original dryer lint duct using an adhesive.

* * * * *